US005836773A

United States Patent [19]

McHugh et al.

[11] Patent Number: 5,836,773

[45] Date of Patent: Nov. 17, 1998

[54] BOARD-TO-BOARD CONNECTOR

[75] Inventors: Robert G. McHugh, Evergreen, Calif.; Yu-Ming Ho, Taipei Hsien, Taiwan

[73] Assignee: Hon Hai Precision Ind. Co., Ltd., Taipei Hsien, Taiwan

[21] Appl. No.: 692,822

[22] Filed: Jul. 29, 1996

[51] Int. Cl.[6] ..... H01R 9/09

[52] U.S. Cl. ..... 439/74; 439/350; 439/733.1

[58] Field of Search ..... 439/74, 660, 444, 439/733.1, 350

[56] References Cited

U.S. PATENT DOCUMENTS

| | | | |
|---|---|---|---|
| 5,057,027 | 10/1991 | Yamada et al. | 439/83 |
| 5,059,140 | 10/1991 | Philipson et al. | 439/610 |
| 5,137,462 | 8/1992 | Casey et al. | 439/374 |
| 5,192,232 | 3/1993 | Lenz et al. | 439/660 |
| 5,199,884 | 4/1993 | Kaufman et al. | 439/74 |
| 5,310,357 | 5/1994 | Olson | 439/660 |
| 5,445,528 | 8/1995 | Frantz | 439/79 |
| 5,626,500 | 5/1997 | Yoshimura | 439/79 |

*Primary Examiner*—Neil Abrams

[57] ABSTRACT

A board-to-board connector assembly (10) includes a socket connector (12) with plural rigid contacts (48) therein and a counterpart plug connector (14) with plural flexible contacts (20) therein. Locking tabs with protrusions are formed on the exterior surfaces (43) of the socket connector (12) and the corresponding recesses (56) are formed in side walls (58) of the plug connector (14) so that there is a retention function between these two mating connectors (12, 14) when they are coupled with each other. The housing (16, 36) of each connector (14, 12) further includes an expansion section (15, 11) at either end for protectively avoiding damage of the contact tails (24, 50) due to exterior impact during delivery. Additionally, the engaging body (52) of the contact (48) of the socket connector (12) is substantially positioned beyond the partition rib (46), and thus the barbs (54) formed on two sides of the engaging body (52) each has a coined portion so that such barb (54) can be substantially completely embedded within the corresponding passage (42) defined between two adjacent ribs (46) for reinforcing the retention function with regard to the housing (36) for preventing contact (48) of the socket connector (12) from deforming or tilting during mating.

9 Claims, 8 Drawing Sheets

BOARD-TO-BOARD CONNECTOR

BACKGROUND OF THE INVENTION

1. Field of The Invention

The invention relates to board-to-board connectors, and particularly to a low profile connector assembly for interconnecting two parallel spaced boards, wherein such connector assembly includes a socket connector with plural rigid contacts therein and a plug connector with plural flexible contacts therein.

2. The Prior Art

Board-to-Board connector assemblies are popularly used in the computer field, for example, U.S. Pat. Nos. 5,161,985 and 5,306,163. Recently, because miniaturization is the trend, the corresponding connector assembly becomes tinier and tinier. This change makes high precision requirements of the connectors, and thus self-locking function is preferred to assure the interconnection between the socket connector and the plug connector. U.S. Pat. No. 5,310,357 discloses the interlocking performance occurring in the connector assembly by means of retention features on the contacts; differently, U.S. Pat. No. 5,395,265 discloses the interlocking performance by means of independent retention devices additionally attached to the housings of the connectors.

Moreover, such prior art does not consider a soldering engagement problem of a board-to-board connection due to a tension which results from mechanical abutment between pins of the plug connector and pins of the socket connector. Therefore, this tension will adversely affect or possibly damage the soldered engagement between the connector and the related printed circuit boards.

Therefore, an object of the invention is to provide a pair of mating connectors with retention means integrally formed with the housings so that such pair of mating connectors can be securely coupled to each other.

Another object of the invention is to provide the protection device on the connector housing for avoiding damage of the contact tails during shipping. Yet, still another object of the invention is to provide a pair of mating connectors including a plug connector and a socket connector to be engaged for a board-to-board interconnection, where the plug connector is configured such that a tension due to engagement of the plug connector and the socket connector is received by the housing portion of the plug connector other than the soldering portion thereof, thus preventing damage to a previous soldering engagement between the plug connector and a corresponding printed circuit board.

Yet, another object of the invention is to provide a low profile connector assembly for a board-to-board interconnection where the space is efficiently saved.

Additionally, another object of the invention is to provide a reinforcement arrangement on the rigid contacts of the socket connector which originally may be tilted during mating with the counterpart plug connector.

SUMMARY OF THE INVENTION

According to an aspect of the invention, a board-to-board connector assembly includes a socket connector with plural rigid contacts therein and a counterpart plug connector with plural flexible contacts therein. The protrusions are formed on the exterior surfaces of the socket connector and the corresponding recesses are formed in side walls of the plug connector so that there is a retention function between these two mating connectors when they are coupled with each other. The housing of each connector further includes an expansion section at either end for protectively avoiding damage of the contact tails due to exterior impact during delivery.

Additionally, the engaging body of the contact of the socket connector is substantially positioned beyond the partition rib, and thus the barbs formed on two sides of the engaging body each has a coined portion so that such barb can be substantially completely embedded within the corresponding slot defined between two adjacent ribs for reinforcing the retention function with regard to the housing for preventing contact of the socket connector from deforming or tilting during mating.

DETAILED DESCRIPTION OF THE PREFERRED EMBODIMENTS

References will now be in detail to the preferred embodiments of the invention. While the present invention has been described with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
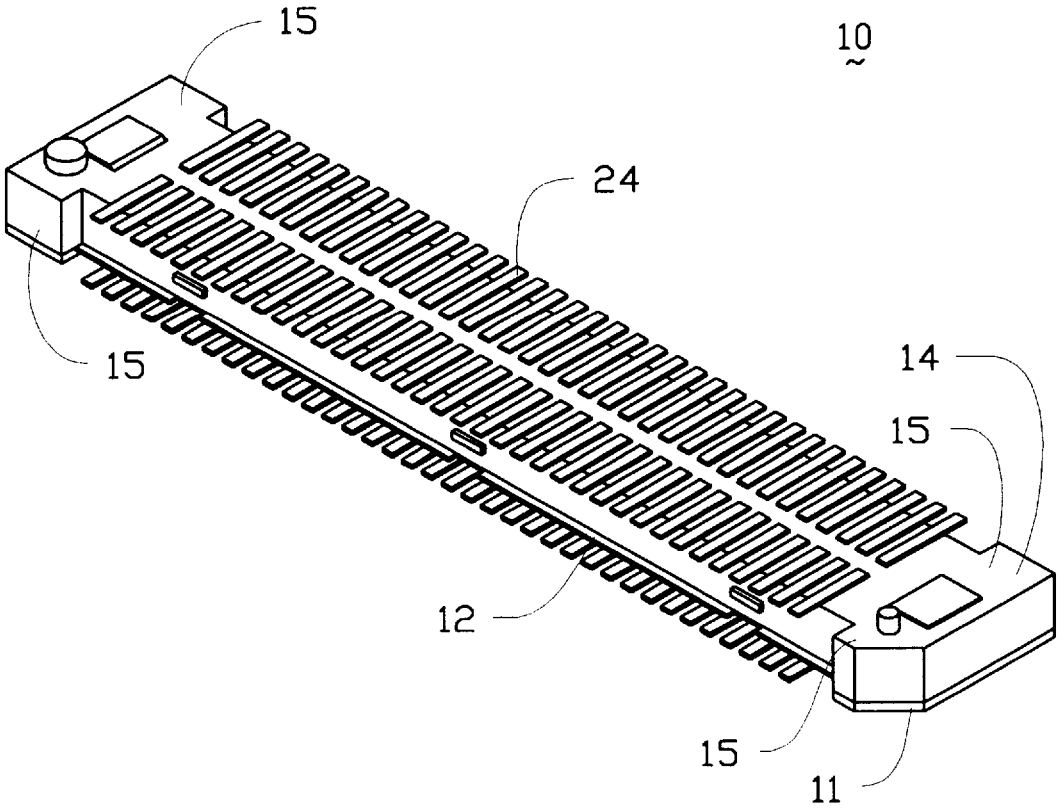
FIG. 1 is a perspective view of a presently preferred embodiment of an assembled connector assembly including a socket connector and a plug connector, according to the invention.
Figure 2:
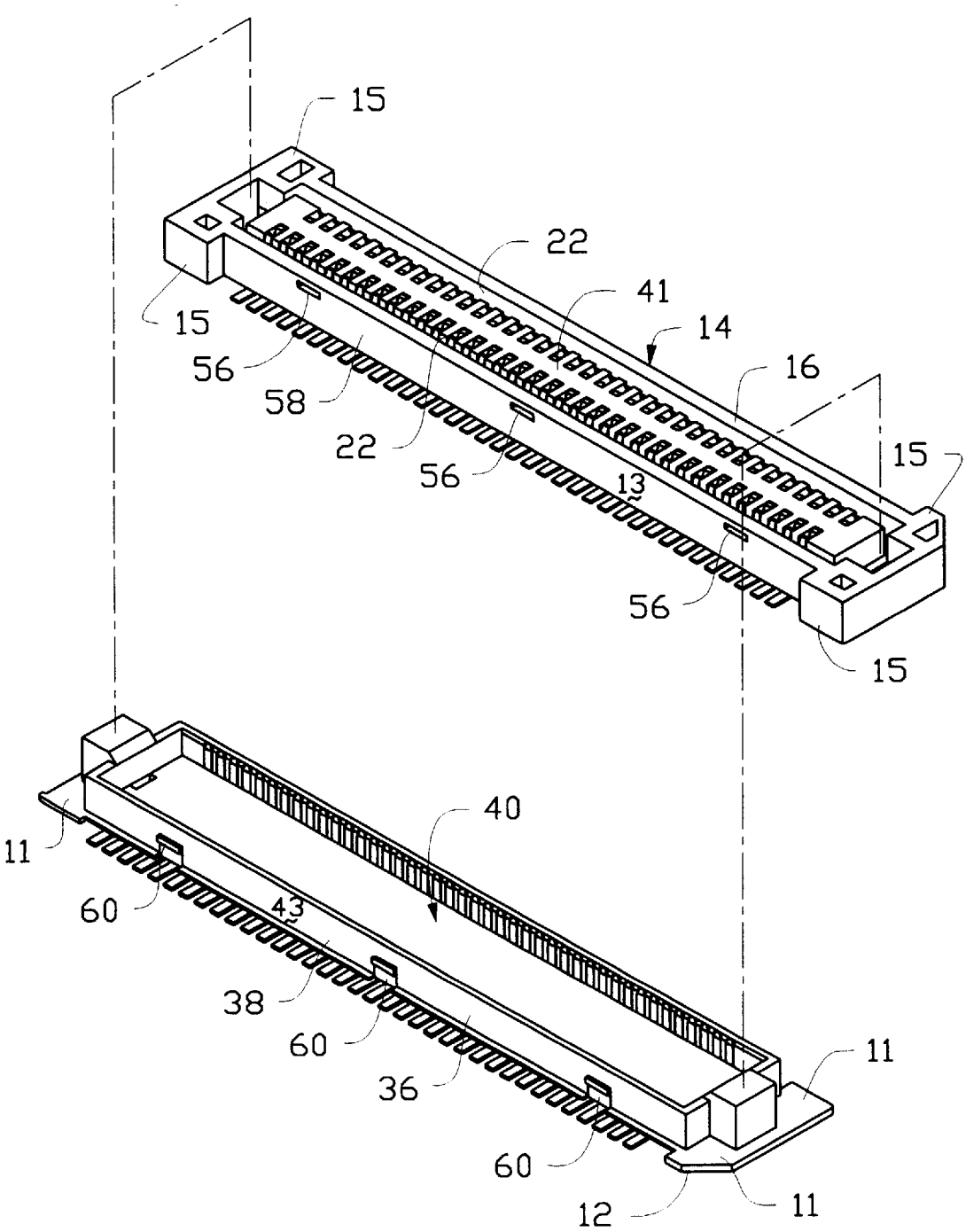
FIG. 2 is an exploded perspective view of the connector assembly of FIG. 1 to show the configurations of the socket connector and of the upside-down plug connector, respectively.

It will be noted here that for a better understanding, most of like components are designated by like reference numerals throughout the various figures in the embodiments. Attention is directed to FIGS. 1 and 2 wherein an electrical connector assembly 10 for use with two parallel spaced boards 100, 102 (FIG. 6) includes a socket connector 12 and a plug connector 14 mating with each other.

Figure 3:
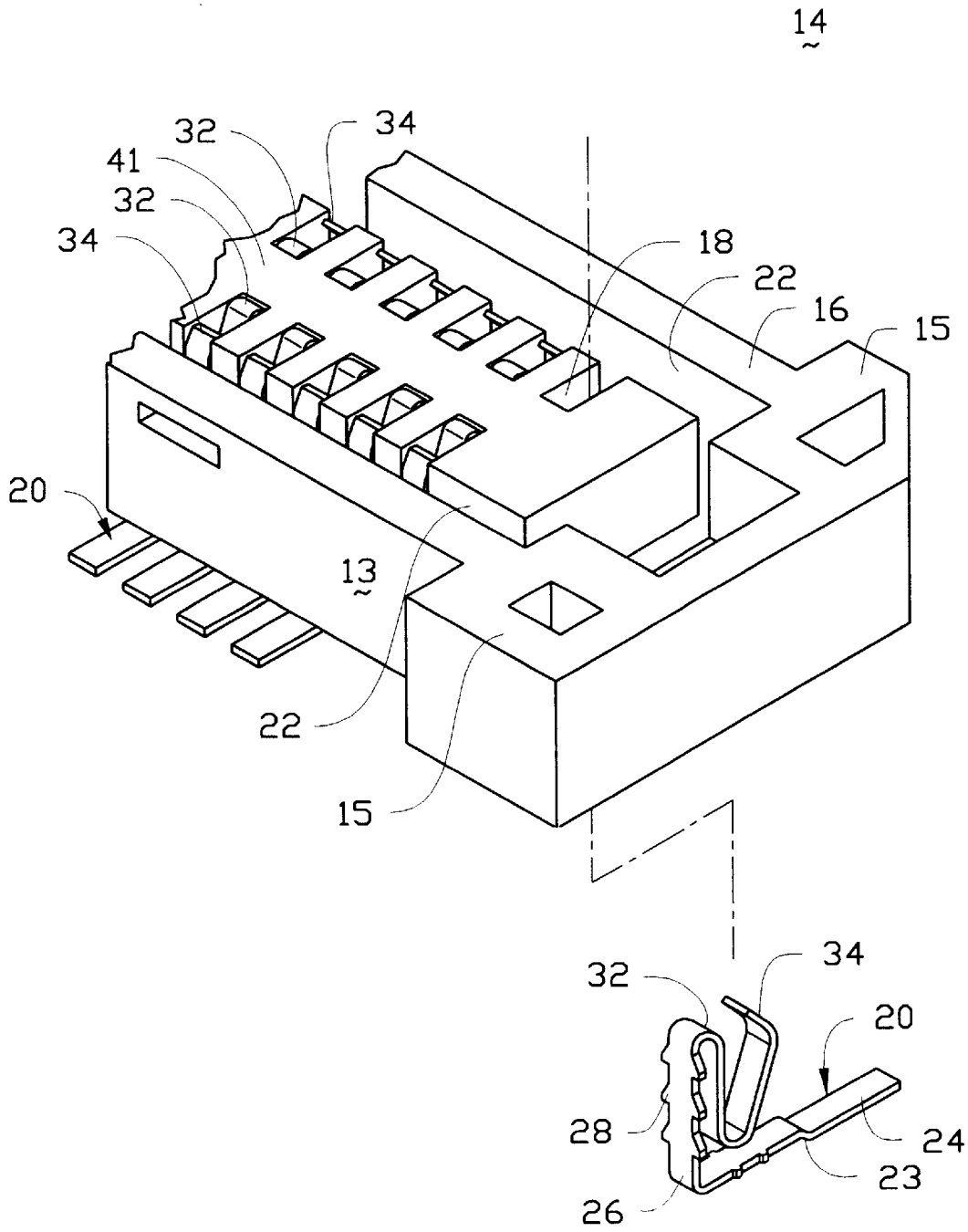
FIG. 3 is a fragmentary perspective view of the upside-down plug connector of FIG. 1 to show the passageway and the contact adapted to be received therein.

Also referring to FIGS. 2 and 3, the plug connector 14, which is in an upside-down manner for easy illustration, includes an insulative housing 16 having two rows of passageways 18 for receiving therein a corresponding number of contacts 20 wherein the passageways 18 of one row are substantially staggered with those of another row. Two lengthwise channels 22 are communicatively positioned aside these two rows passageways 18 for receiving an insulative housing 36 of the socket connector 12, and this will be illustrated in detail later.

Figure 3A:
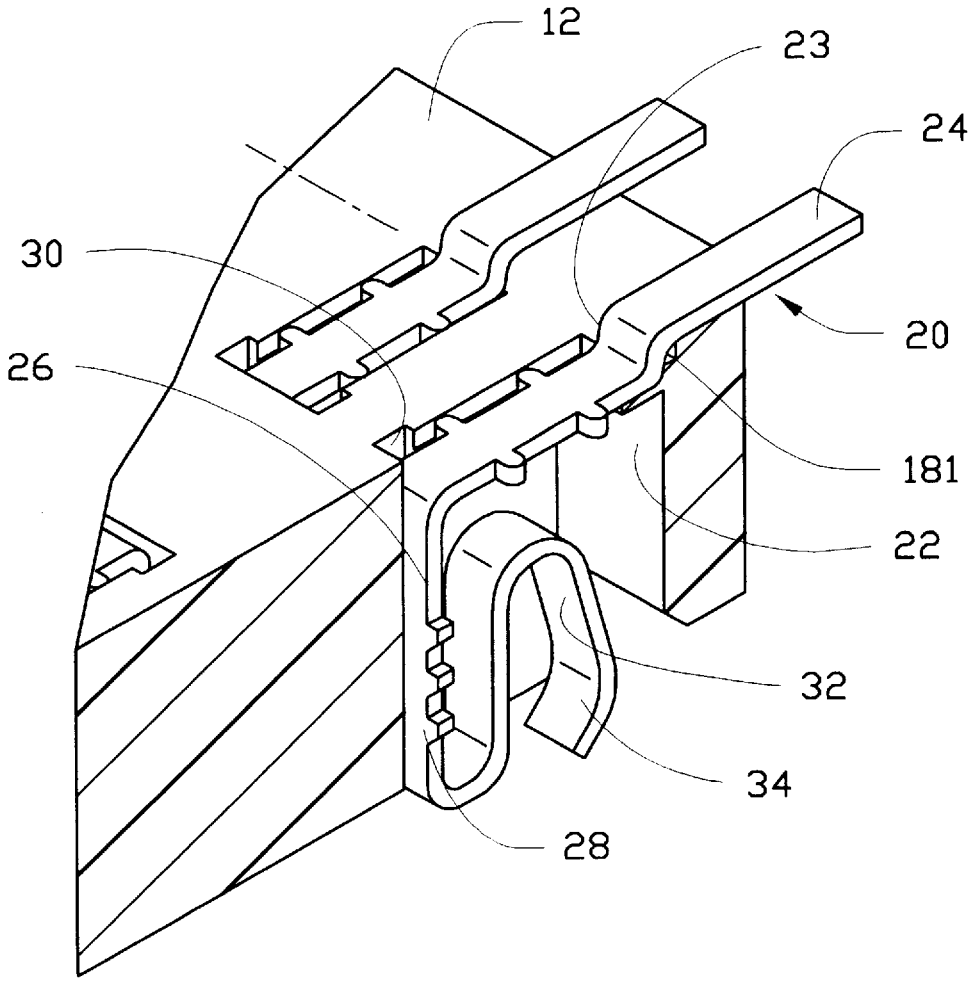
FIG. 3(A) is an enlarged fragmentary perspective view of the plug connector of FIG. 1 to show the shallows in the passageway.

The contact 20 is formed to include a tail section 24, a vertical main body 26 with barbs 28 on two sides for engagement within a pair of shallow grooves 30 (FIG. 3(A)) in the passageway 18 so that the contact 20 can be retainably received within the passageway 18. A multiple-bend spring section 32 integrally extends from the main body 26 of the contact 20 with an engagement apex 34 projecting into the channel 22 aside. The tail section 24 of the contact 20 is soldered to the related printed circuit board 102. The tail section 24 is further formed with a slanted step section 23 at an intermediate portion thereof. The periphery which defines the passageway 18 is further formed with a stepped wall portion 181 which mates with the slanted step section 23 of the contact 20.

Figure 4:
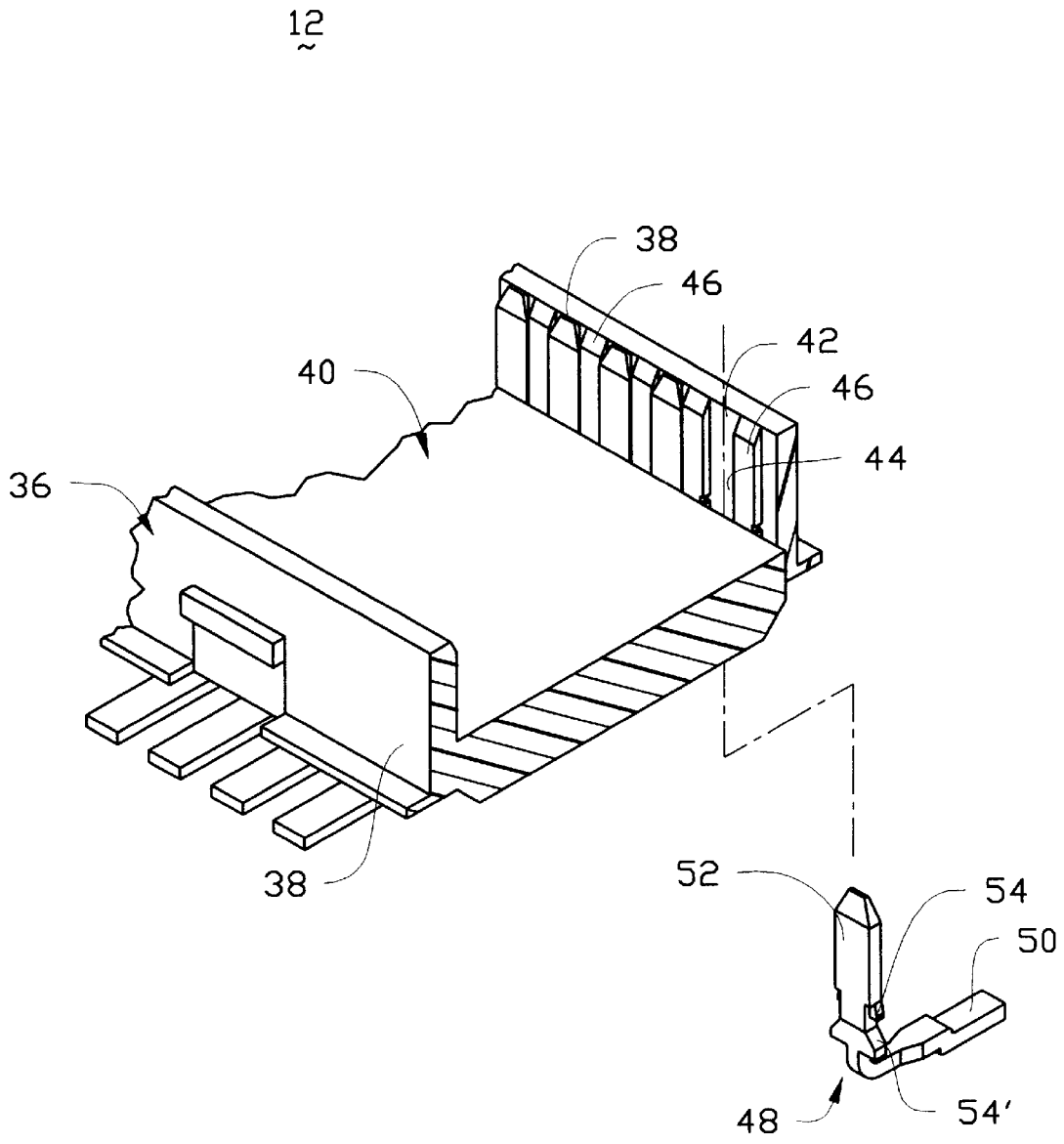
FIG. 4 is a fragmentary perspective view of the socket connector to show the passageway and the contact adapted to be received therein.

Oppositely, referring to FIG. 4, the socket connector 12 includes the insulative housing 36 having circumferential walls 38 defining a large center cavity 40 therein for receiving the corresponding center portion 41 (FIG. 3) of the plug connector 14 therein. A plurality of passages 42 are formed along the inner surfaces 44 of two side walls 38, by a series of ribs 46 on the inner surface 44 of the side walls 38, for receiving therein a corresponding number of contacts 48, wherein each passage 42 is defined by two adjacent ribs 46. Each contact 48 is generally of a rigid type including a tail section 50 and a vertical main body 52 with barbs 54, 54' on two sides for being generally retainably received within the corresponding passage 42.

Figure 5:
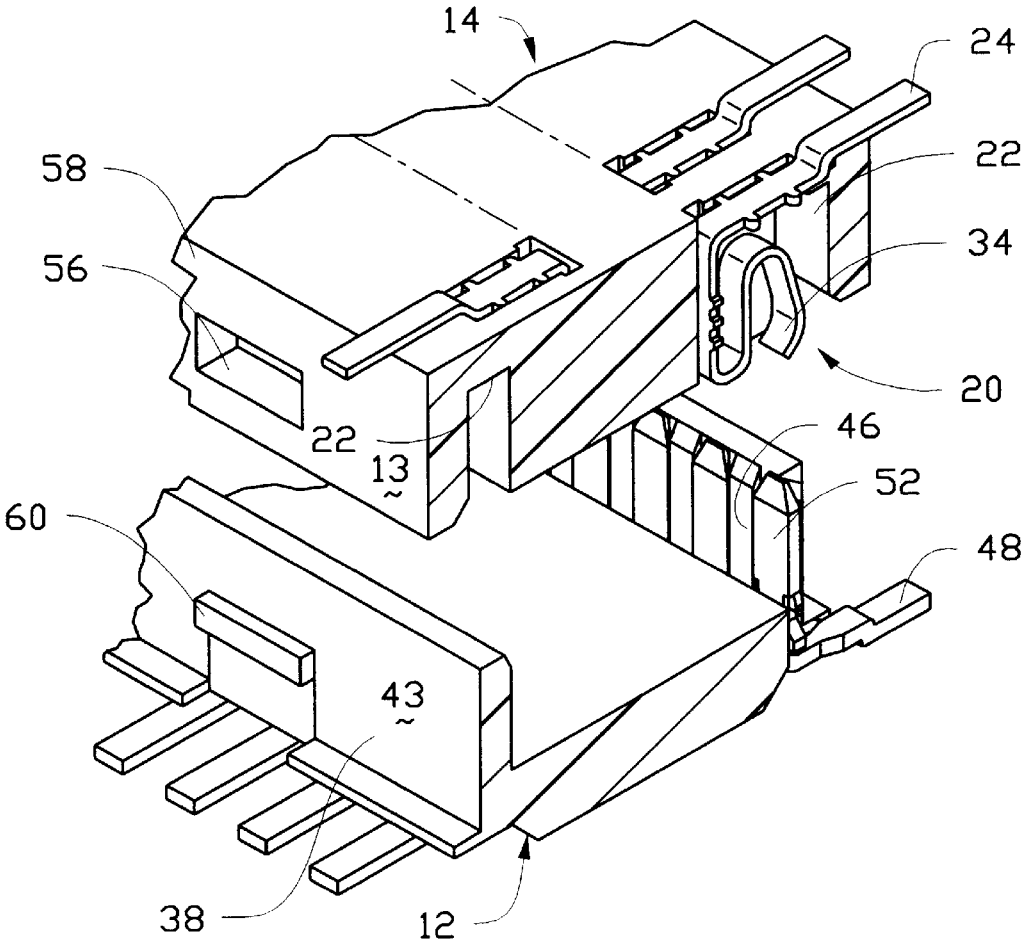
FIG. 5 is fragmentary perspective view of the separate socket connector and plug connector adapted to be coupled to each other.
Figure 6:
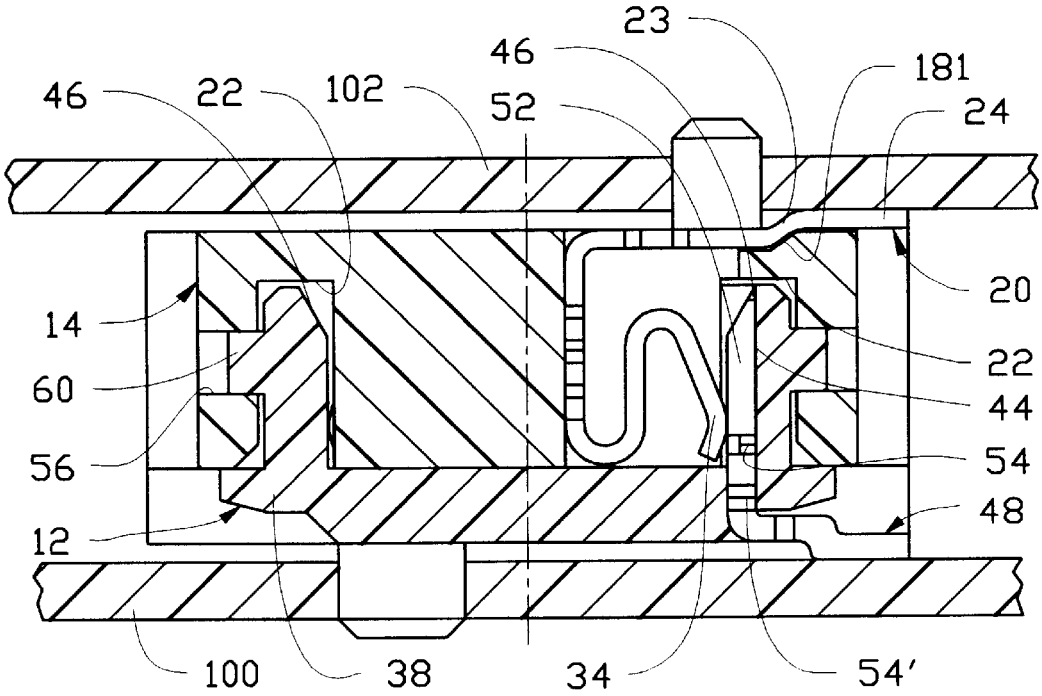
FIG. 6 is a cross-sectional view of the assembled socket connector and plug connector of the assembly to show how the plug socket is received within the socket connector and how the contact of the plug connector engages the contact of the socket connector.

Therefore, referring to FIGS. 5 and 6, the socket connector 12 and the plug connector 14 can be solderably mounted on two opposite parallel boards 100, 102, and be coupled to each other by means that the two side walls 38 of the housing 36 of the socket connector 12 with the associated contacts 48 are inserted into the corresponding channels 22 in the plug connector 14. In other words, the center portion 41 of the plug connector 14 is received within the center cavity 40 of the socket connector 12. Under this situation, the engagement apex 34 of each contact 20 of the plug connector 14 may properly abut against the corresponding main body 52 of the contact 48 of the socket connector 12, thus forming mechanical and electrical connection between the socket connector 12 and the plug connector 14 and substantially interconnecting these two parallel boards 100, 102.

However, the soldering engagement (mounting) between the plug connector 14, the socket connector 12, and the related printed circuit boards 102 and 100 is apt to be damaged due to a tension resulting from a mechanical abutment between contacts 20 of the plug connector 14 and contacts 48 of the socket connector 12. Therefore, in the present invention, the respective tensions of each contact 20 of the plug connector 14 and each contact 48 of the socket connector 12 are respectively absorbed by the stepped wall portion 181 of the plug connector 14 and the inner surface 44 of the related side wall 38 of the socket connector 12.

It can be seen that, in FIGS, 2 and 5, to provide a retention function between the socket connector 12 and the plug connector 14, a plurality of openings 56 is formed in the lengthwise walls 58 of the plug connector 14 for cooperation with a corresponding number of locking tabs 60 formed on the exterior surfaces 43 of the side walls 38 of the socket connector 12.

Moreover, referring to FIGS. 1–3, the housing 16 of the plug connector 14 includes a pair of expansion portions 15 at two opposite ends for only providing a better stabilization of the connector 14 on the board 100, but also protecting the contact tail sections 24 against any improper hit along the lengthwise direction adjacent the exterior surface 13 of the housing 16. The socket connector 12 is also provided with the similar structures 11, i.e., the expansion portions at two ends.

Figure 7:
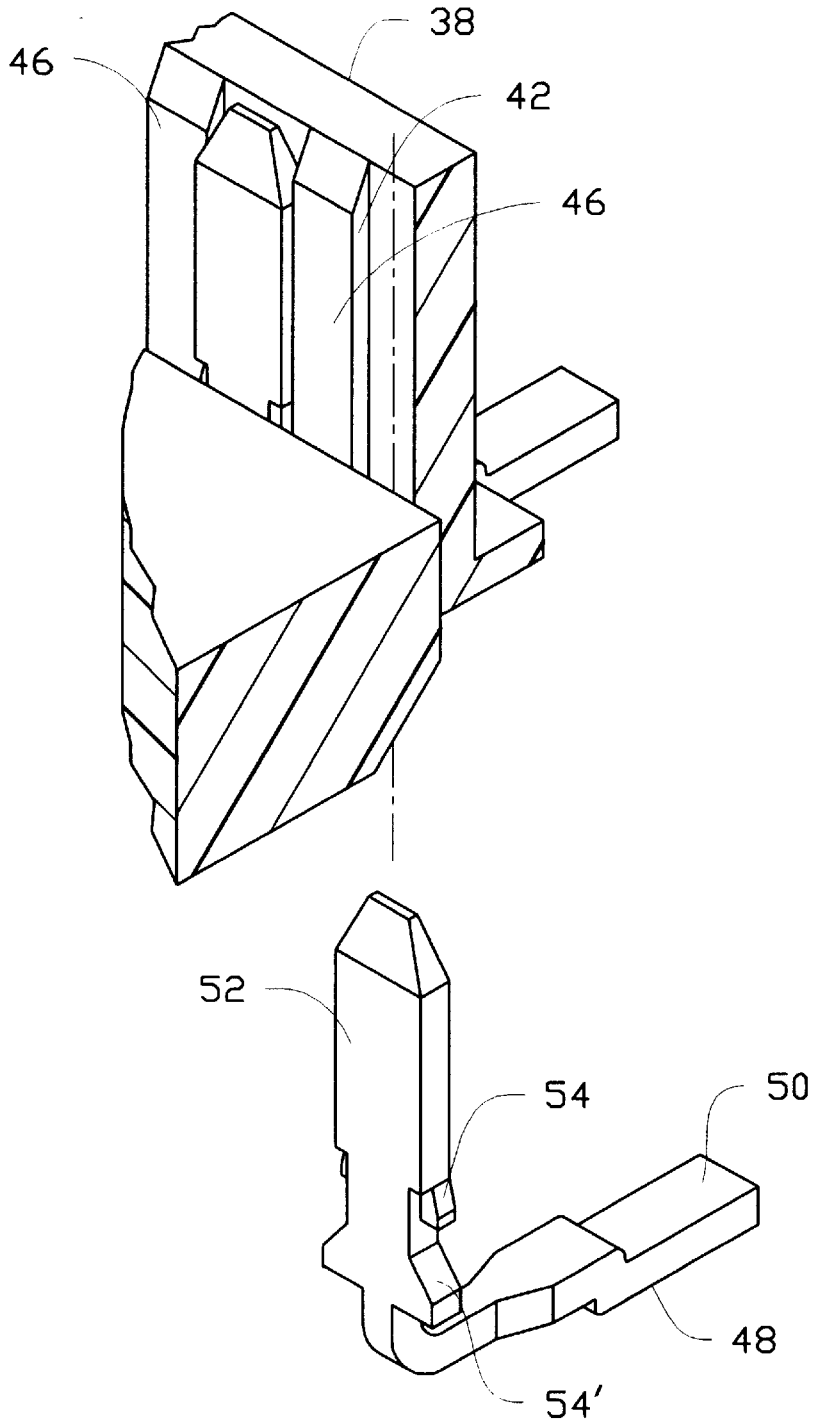
FIG. 7 is an enlarged fragmentary perspective view of the socket connector to exaggeratedly show the thickness difference between the contact and the adjacent ribs, and to show how the engaging body of the contact of the socket connector is sandwiched between two adjacent ribs defining the slot in which the contact is positioned.

Additionally, FIG. 7 apparently discloses the main body 52 of the contact 48 of the socket connector 12 has a thickness being larger than the adjacent ribs 46. Thus, the main body 52 of the contact 48 is substantially positioned beyond the mating surfaces of the ribs 46 and it will assure that the engagement apex 34 of the contact 20 of the plug connector 14 definitely engages the main body 52 of the contact 48 without obstacles from the ribs 46. Based on this structural arrangement, a portion of the front barbs 54 may have no corresponding material of the ribs 46 to butt against if the front barbs 54 has the same thickness with the main body 52 of the contact 48 as what rear barbs 54' do. The unbalanced retention from the front barbs 54 and the rear barbs 54' may result in a "couple" effect which makes tendency of tilting of the contact 48 between the two adjacent ribs 46. Therefore, in this embodiment, the front barbs 54 has been coined on their outermost portions such that the processed thinner front barbs 54 having the similar thickness as that of the adjacent ribs 46, may fully and increasingly engaged within the two adjacent ribs 46, thus incorporating the rear barbs 54' to perform a better and stable retention of the contact 48 in the housing 36.

It is also noted that in comparison with other prior art board-to-board designs, the present invention discloses a wider dimension of the plug connector 14 which allows a multiple-bend curved spring section of the contact therein to achieve the required resiliency or normal force instead of a higher dimension of the prior arts for achieving the same. Therefore, the height of the plug connector 14 of the invention can be reduced to be only 2.25 mm, and this type of low profile connector arrangement is very helpful in designing a thinner notebook computer. On the other hand, the contact 20 of the plug connector 14 is made by forming barbs 28 on each side of the main body 26 unlike other prior arts which are directly made by blanking or stamping and generally require additional retention posts aside the main body thereby increasing width dimension. Therefore the invention can achieve the minimum width and height of the connector assembly 10.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. An electrical connector assembly for board-to-board interconnection, comprising:

a plug connector having an insulative first housing defining two rows of staggered passageways for receiving a corresponding number of flexible contacts therein;

a pair of channels communicatively positioned aside two rows of the staggered passageways, respectively, under the condition that an engagement apex of each of said contacts projects into the corresponding channel;

a socket connector including an insulative second housing having circumferential walls with a plurality of ribs formed on two interior surfaces of two side walls, said ribs defining a plurality of passages for receiving therein a plurality of rigid contacts each of which includes front barbs and rear barbs, and said front barbs are coined to be thinner than the rear barbs, wherein an engagement surface of a main body of each of the rigid contacts lies above mating surfaces of two adjacent ribs; whereby when the socket connector and the plug connector are engaged with each other, the two side walls of the socket connector are received within the corresponding channels of the plug connector, respectively, under the condition that each flexible contact of the plug connector engages each corresponding rigid contact of the socket connector.

2. The assembly as described in claim 1, wherein said assembly further includes latching means respectively formed on the first housing of the plug connector and the second housing of the socket connector.

3. The assembly as described in claim 2, wherein said latching means includes a plurality of openings and a corresponding number of protrusions.

4. The assembly as described in claim 1, wherein at least one of said housings has a pair of expansion portions at two opposite ends for stabilization and protection purposes.

5. The assembly as described in claim 1, wherein said flexible contact of the plug connector includes a main body with barbs on two sides, and a multiple-bend curved spring section extending therefrom with said engagement apex projecting into the corresponding channel.

6. A socket connector of a board-to-board connector assembly, comprising:

an insulative housing having circumferential walls defining a center cavity;

a plurality of ribs formed on two interior surfaces of two side walls of the housing;

a passage being formed between every two adjacent ribs for receiving a rigid contact therein;

the contact including a main body protruding above mating surfaces of the adjacent ribs, said main body further including upper barbs and lower barbs wherein the upper barbs are designedly coined to be flattened in comparison with the originally dimensioned lower barbs.

7. The socket connector as described in claim 6, wherein said housing includes a plurality of protrusions for latching.

8. The socket connector as described in claim 6, wherein said housing includes a pair of expansion portions at two opposite ends thereof for stabilization and protection.

9. An arrangement for efficiently balancing a pair of retention forces of a contact within a housing of a connector, comprising:

said housing having at least one wall farming at least two parallel spaced ribs thereon to define a passage therebetween;

said contact including a main body having both upper barbs and lower barbs on two sides thereof for snug reception within said passage; wherein a thickness of the main body is substantially larger than a depth of the passage so that the engagement surface of the main body lies above a top mating surface of the adjacent ribs, and outermost portions of the upper barbs are coined to be flattened so that the upper barbs are generally as thin as the adjacent ribs for enhancement of retention forces thereof.

* * * * *